US006274001B1

(12) United States Patent
Mohan

(10) Patent No.: US 6,274,001 B1
(45) Date of Patent: Aug. 14, 2001

(54) METHOD FOR CALENDERING SURFACE SIZED PAPER/PAPERBOARD TO IMPROVE SMOOTHNESS

(75) Inventor: K. Krishna Mohan, Staten Island, NY (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 08/955,135

(22) Filed: Oct. 21, 1997

(51) Int. Cl.[7] ..... D21H 25/00; D21H 25/04; D21H 25/06

(52) U.S. Cl. ..... 162/206; 162/205; 162/135; 162/207; 34/443; 34/445; 100/38; 427/361; 427/363; 427/364

(58) Field of Search ..... 162/204, 205, 162/206, 207, 361, 358.5, 359.1, 360.2, 360.3, 135, 137; 100/40, 334, 162 R, 38, 193, 73, 163 A; 34/445, 117, 114, 306, 144, 443, 611, 528, 543, 561, 444; 427/211, 361, 296, 363–366, 428

(56) References Cited

U.S. PATENT DOCUMENTS

| | | | | |
|---|---|---|---|---|
| 4,207,143 | * | 6/1980 | Glomb et al. | 162/207 |
| 4,596,633 | * | 6/1986 | Attwood | 162/206 |
| 4,606,264 | | 8/1986 | Agronin et al. | 100/38 |
| 4,624,744 | * | 11/1986 | Vreeland | 162/206 |
| 4,823,688 | | 4/1989 | Wedel et al. | 100/93 RP |
| 4,945,654 | | 8/1990 | Mason | 34/23 |
| 5,045,342 | | 9/1991 | Boissevain et al. | 427/8 |
| 5,065,673 | | 11/1991 | Taylor et al. | 100/40 |
| 5,106,655 | | 4/1992 | Boissevain et al. | 427/296 |
| 5,316,624 | | 5/1994 | Racine | 162/205 |
| 5,378,497 | | 1/1995 | Johnson et al. | 427/211 |
| 5,505,820 | | 4/1996 | Donigian et al. | 162/206 |
| 5,522,312 | | 6/1996 | Johnson | 100/74 |
| 5,632,101 | * | 5/1997 | Oechsle | 34/445 |
| 5,771,603 | * | 6/1998 | Kotitschke et al. | 34/446 |

FOREIGN PATENT DOCUMENTS

2097724 * 12/1997 (CA) .

OTHER PUBLICATIONS

Gratton et al., "Temperature–gradient calendering of foodboard," Jan., 1988, Tappi Journal, pp 81–86.*

Vreeland et al., "Substrata thermal molding, Part 2: putting theory to pratice," Dec. 1988, Tappi Journal, pp 201–206.*

Vreeland et al., "Substrata Thermal Molding, Part 1", Nov. 1989 Tappi Journal, pp. 139–145.

Krenkel, "Glätteerzeugung und Glättemessung", Wochenblatt für Papierfabrikation, 17 (1976), pp. 621–624.

* cited by examiner

*Primary Examiner*—Jose Fortuna
(74) *Attorney, Agent, or Firm*—Ostrager Chong & Flaherty LLP

(57) ABSTRACT

A calendering method which enhances the smoothness of surface sized paper/paperboard by a combination of temperature and moisture gradient calendering processes without the fiber sticking/picking problems that affect runnability and without using waterboxes. The moisture gradient calendering is performed so that the cross direction moisture profile can be corrected and high smoothness levels can be obtained. Heated calender rolls form a hot pressure nip having a temperature greater than the temperature of the moisturized web. Lubricant is applied to both sides of the web to prevent fiber sticking/picking in the hot nip. The lubricant may be applied by the size press, by the moisturizing showers or by separate lubricant showers. The smoothness developed by moisturizing and hot nip calendering is substantially irreversible.

8 Claims, 6 Drawing Sheets

METHOD FOR CALENDERING SURFACE SIZED PAPER/PAPERBOARD TO IMPROVE SMOOTHNESS

FIELD OF THE INVENTION

This invention generally relates to hot hard calendering of paper and paperboard to improve smoothness. In particular, the invention relates to hot hard calendaring of paper/paperboard which has been surface sized with starch.

BACKGROUND OF THE INVENTION

One of the methods of improving the smoothness of paper/paperboard during the calendering operation is to pass the paper/paperboard through one or more heated nips which are at a temperature higher than the temperature of the web. The surface of the paper/paperboard that is to be finished is pressed against the heated roll. The applied heat raises the surface temperature of the paper/paperboard to the glass transition temperature, which causes the fibers to soften and conform to the surface of the roll. Moisture (i.e., water or steam) can also be added before the nip to the surface that is treated to further lower the glass transition temperature. Thus, gradients in the temperature and moisture level tend to lower the glass transition temperature preferentially on the external surfaces of the paper/paperboard and allow the sheet to achieve a desired smoothness without significant reduction in caliper.

Temperature gradient calendering is a known method of enhancing the smoothness of paper/paperboard without sacrificing caliper. However, high temperature alone cannot yield the degree of smoothness that is required for some grades. Moisture is essential for the smoothness development. This can be observed in FIG. 1 where Hagerty smoothness of bleached board calendered in a steel-steel nip at 350° F. is shown as a function of the apparent density of the final product. It should be noted that within the range of applied niploads, calendering without moisture addition can only result in a minimum smoothness of 180 units while the sheet calendered with addition of moisture to raise the total moisture content by 0.5% can attain a smoothness of 130 Hagerty units.

The prevalent method of moisture addition for most board and bristol grades is by using waterboxes on at least one calender stack. This process usually consists of overdrying the sheet to obtain a flat moisture profile of 1–2% and then adding water using waterboxes. The moisture pickup is typically greater than 10–12% of the conditioned weight of the paper/paperboard and can sometimes be as much as 15–18% of the conditioned weight of the paper/paperboard. One purpose of overdrying is to correct for any moisture nonuniformity. Overdrying the sheet can only be achieved by running the machine slower, thereby reducing production. In addition, waterboxes tend to cause several operational problems, including breaks and difficulty during the threading process. The high level of moisture added with the waterboxes in a multiroll calender stack makes it necessary to employ drying means so that the reel moisture can be maintained at 5–8%. This drying is typically accomplished using intercalender dryers which are usually run without any supporting fabric. Following this drying, the paper sheet is passed through a multiroll stack with several nips to be subjected to increasing pressure, whereby the web develops good smoothness and high density. One of the advantages of waterboxes is that the water applied can incorporate other functional additives, such as dyes, lubricants, binders such as starch, and film formers such as polyvinyl alcohol.

Addition of the moisture in such a way that only the surface is moistened to a lower glass transition temperature can result in a paper/paperboard having high smoothness and low density. An application similar to this has been suggested in U.S. Pat. No. 5,378,497, wherein the moisture is applied before the calendering nip using a metering size press. The '497 patent further discloses that the smoothness developed is irreversible and is useful in operations that involve rewetting the sheet, such as coating/tinting. The metering size press method applies a lower amount of moisture than does the waterbox but cannot correct profile nonuniformities. In addition, installation of a metering size press involves significant cost and machine reconfiguration.

In addition to the foregoing, the temperature gradient calendering of moistened paper/paperboard that is surface sized is impeded by starch and associated fibers picking and sticking on the heated roll. This problem tends to be aggravated at the higher niploads and temperatures required for achieving high smoothness levels. The sticking and fiber pulling are caused by the starch or other binders that are added in the size press and lead to runnability problems.

SUMMARY OF THE INVENTION

The present invention is a method and an apparatus for calendering which improves the smoothness of paper/paperboard without sacrificing caliper or stiffness. The concept in accordance with the invention can be applied for improving the smoothness of file folder, bleached liner, liquid packaging board, rawstock for coated bristols, linerboard and paper that have a high smoothness requirement. All of these grades are surface sized with variations of starch (pearl, preoxidized, hydroxyethyl), typically in a size press.

The calendering method in accordance with the present invention enhances the smoothness of surface sized paper/paperboard by a combination of temperature and moisture gradient calendering processes without the fiber sticking/picking problems that affect runnability. The moisture is applied to one or both sides of the web using one or more banks of independently controllable showers which allow the cross direction moisture profile to be corrected. One or more heated calender rolls form one or more hot nips having a temperature greater than the temperature of the moisturized web. Lubricant is applied to both sides of the web to prevent fiber sticking/picking in the hot pressure nips. The lubricant may be applied by the size press, by the moisturizing showers or by separate lubricant showers. The smoothness developed by moisturizing and hot nip calendering is substantially irreversible. Calendering of the moisturized web in the hot pressure nips produces high smoothness levels.

The present invention is further directed toward the retrofitting of a conventional machine calendering line having waterboxes with one or more banks of moisturizing showers. In this case, the waterboxes are not used to apply moisture to the paperboard, i.e., the waterboxes are either removed or left in place but not activated to apply liquid to the paperboard.

DETAILED DESCRIPTION OF THE PREFERRED EMBODIMENTS

Figure 2A:
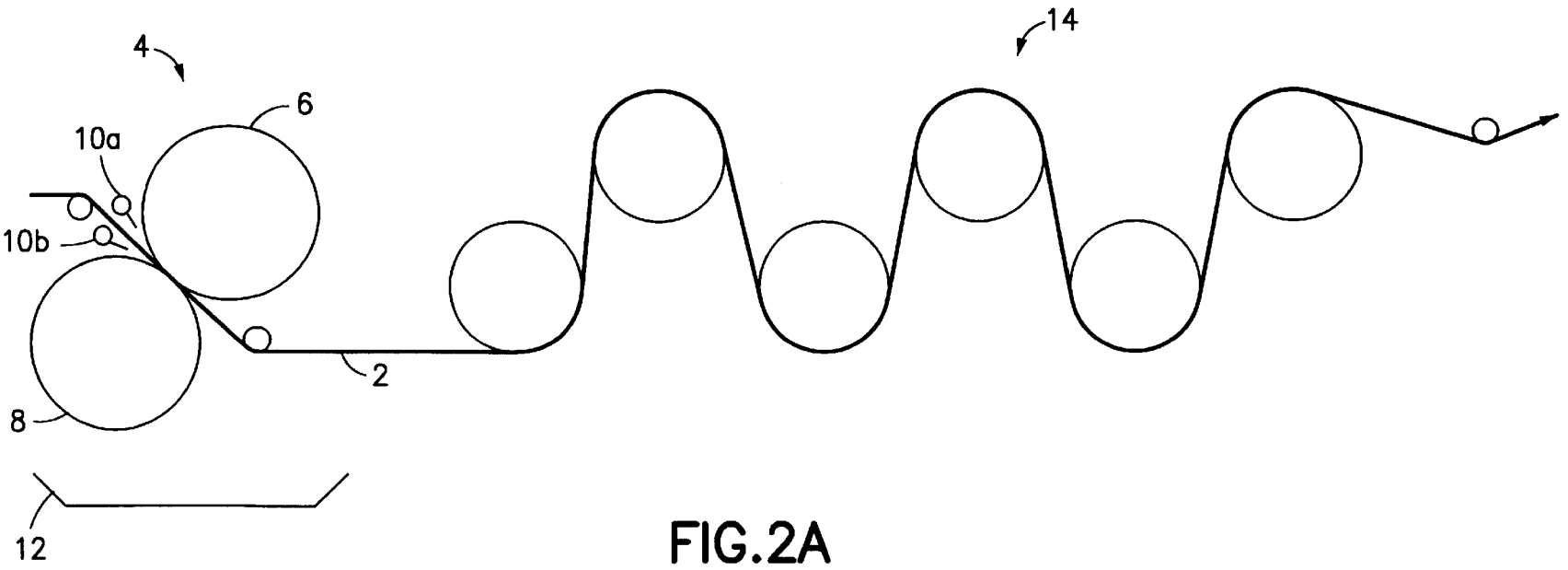
FIG. 2A is a diagrammatic view of the size press and the dryer section in accordance with the preferred embodiment of the present invention.
Figure 2B:
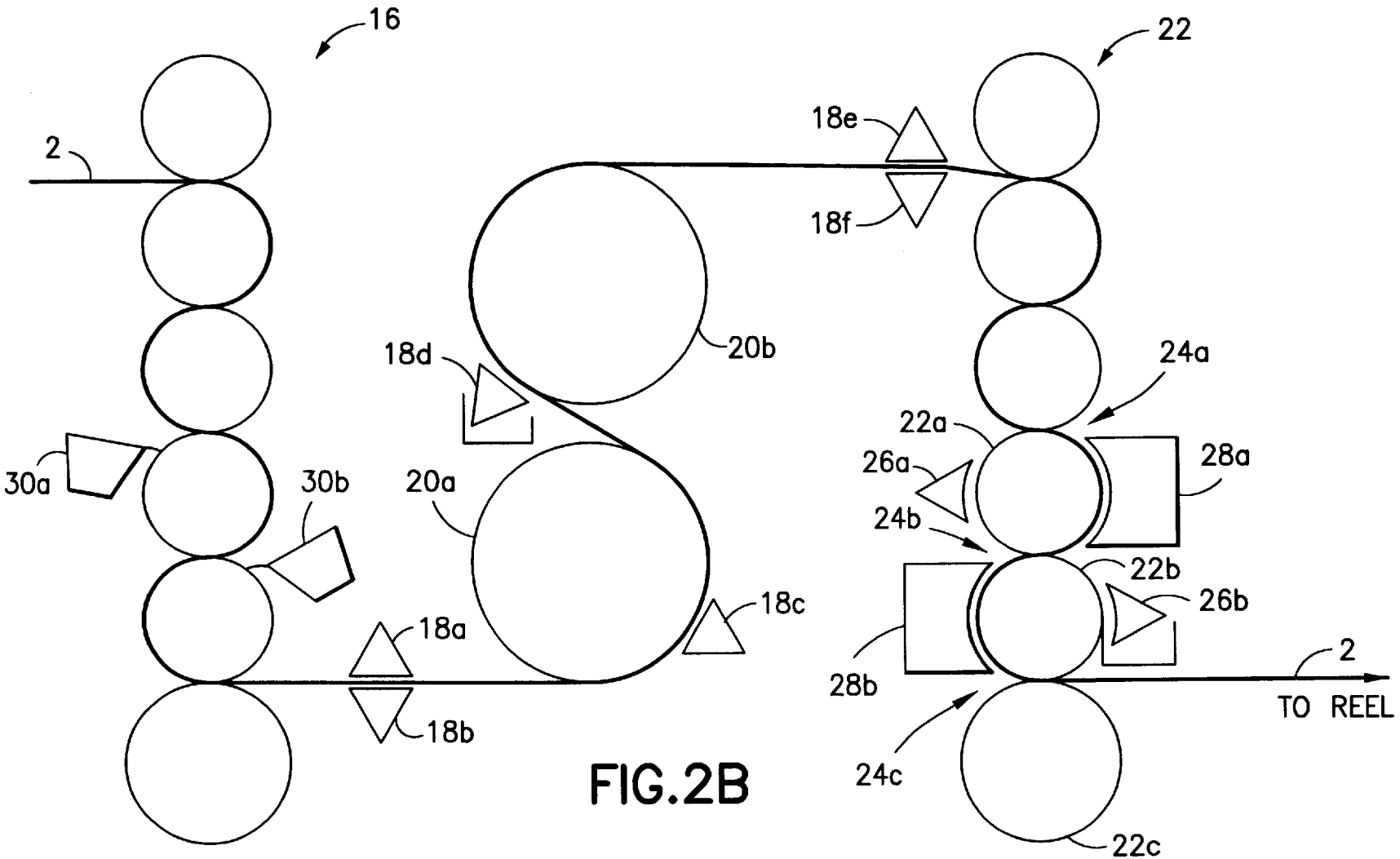
FIG. 2B is a diagrammatic view of a retrofitted machine calendering line comprising a wet calender stack having waterboxes, at least one bank of moisturizing showers and a calender stack having at least one heated calender roll in accordance with the preferred embodiment of the present invention.

The preferred embodiment of the present invention is shown in FIGS. 2A and 2B. Referring to FIG. 2A, the paper/paperboard web 2, after drying in the main section (not shown), is passed through a size press 4 (e.g., of the puddle or metering type) where the amount of pickup can be controlled. Sizing operations are carried out primarily to provide paper/paperboard with resistance to penetration by aqueous solutions. The treatment also improves the surface characteristics and certain physical properties of the paper/paperboard. The present invention involves surface sizing, in which surface voids in the sheet are filled with starch or other binder particles.

Figure 1:
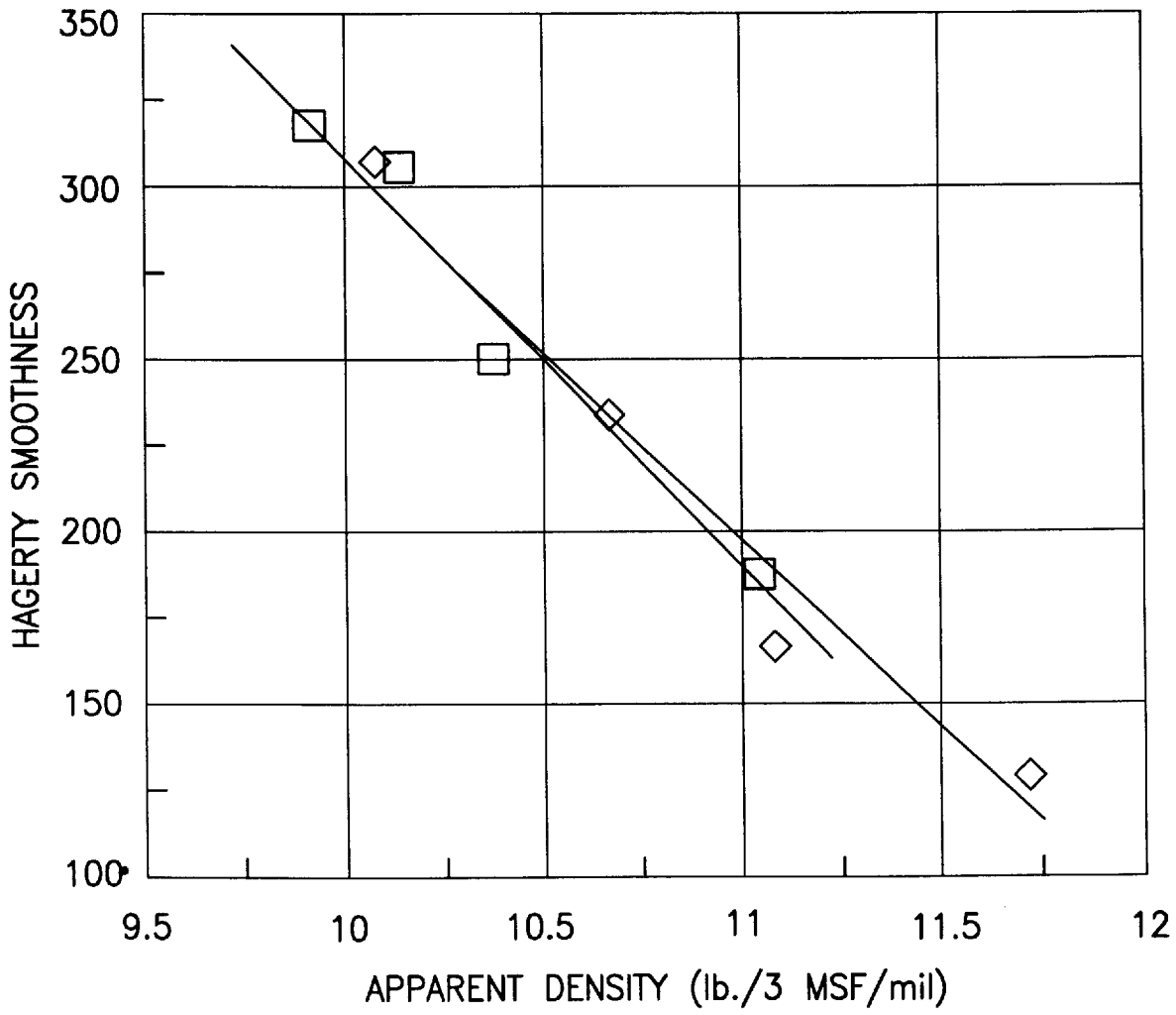
FIG. 1 is a graph showing the Hagerty smoothness of bleached board calendered in a steel-steel nip at 350° F. plotted as a function of the apparent density (lb./3 MSF/mil) of the final product. The data points were obtained by hot hard calendering with no added moisture (□) and with addition of 0.5% moisture by weight (◇).

In accordance with one preferred embodiment of the invention, the size press 4 has an inclined configuration. However, it will be appreciated by persons skilled in the art that the use of an inclined configuration is not necessary. In the alternative, the size press may be horizontal or vertical or have metering elements such as a rod or blade. In the inclined size press shown in FIG. 1, the web 2 passes through the nip between a pair of opposing size press rolls 6 and 8 at an angle of inclination between 0 and 90°, e.g., 45°. The entering nip is flooded with sizing solution supplied on both sides of the web by respective banks of solution supply tubes 10*a* and 10*b* spaced in the sheet cross direction. The paper/paperboard absorbs some of the solution and the unabsorbed solution is removed by the pressure in the nip. The overflow solution is collected in a pan 12 arranged directly below the press rolls and is recirculated back to the nip through the solution supply tubes.

The size press 4 contains a starch solution (e.g., unmodified, acid modified, preoxidized or hydroxyethylated) having a starch concentration in the range of 1–10%. The size press solution can also contain clays and other fillers. In addition, in accordance with one preferred embodiment of the present invention, the size press solution contains a lubricant that is compatible with the starch and other binders. This lubricant can belong to a class of polyethylene emulsions or can be a polyglyceride. The size press-treated paper/paperboard is dried in the dryer section 14 to a moisture level of 4–6%.

Following the size press treatment and drying, the paper/paperboard is passed through a first multi-roll calender stack 16 shown in FIG. 2B. The calender stack 16 may be equipped with one or more conventional waterboxes. FIG. 2B shows a wet stack having two conventional waterboxes 30*a* and 30*b* which apply water to respective sides of the paper web.

As described in greater detail hereinafter, because the machine calendering line shown in FIG. 2B is retrofitted with moisturizing showers in accordance with the present invention, the waterboxes 30 are not used to apply moisture to the paper web, i.e., the waterboxes are either removed or left in place but not activated to apply liquid to the paper web.

Although one aspect of the present invention is the retrofitting of a conventional paper machine calendering line with moisturizing showers, it will be appreciated that in accordance with another aspect of the invention, water and steam showers and hot nip calender rolls can be incorporated in a calendering line without waterboxes. It is believed that both the latter combination of elements as well as the retrofitting of a calendering line having a wet calender stack with moisturizing showers are not known in the prior art. In accordance with yet another aspect of the invention, the first calender stack 16 may be eliminated or not used if the density development it provides are not needed. Where the first calender stack is present but not needed, the calender rolls can be raised so that the web passes around the rolls without passing through any pressure nips.

After the dried paper/paperboard has been calendered in multi-roll stack 16, the paper/paperboard is moisturized using one or more moisturizing showers 18 on one or both sides of the web. The moisturizing showers may consist of water showers (e.g., hydraulic, air atomized or ultrasonic showers) or steam showers or combination of water showers and steam showers. This moisturization may be performed after the web exits the first multi-roll calender stack 16 and before the web enters the second multi-roll calender stack 22. The latter stack incorporates a pair of heated calender rolls 22*a* and 22*b* which form a hot pressure nip 24*b* therebetween. In addition, heated calender roll 22*a* and the unheated calender roll immediately above it form a hot pressure nip 24*a*, while heated calender roll 22*b* and the unheated calender roll immediately below it form a hot pressure nip 24*c*. Because the pressure in each nip is a function of the weight of the calender rolls above that nip, the nip pressure increases from hot pressure nip 24*a* to hot pressure nip 24*c*. In accordance with one preferred operating mode, the pressure in nip 24*a* is about 2,300 psi; the pressure in nip 24*b* is about 2,875 psi; and the pressure in nip 24*c* is about 3,450 psi.

In accordance with the preferred embodiment of the invention, calender roll 22*a* is heated by a first external induction heater 28*a* and calender roll 22*b* is heated by a second external induction heater 28*b*. However, it will be appreciated by persons skilled in the art that other conventional means could be used to heat calender rolls 22*a* and 22*b*. For example, the hot pressure nips can be created by heating one or more of the rolls in the second stack using internal steam, oil or other heating fluid, or using internal induction coils. The heat input into the rolls should be sufficient to maintain a roll surface temperature of 250–400° F. during calendering of the web.

The web may optionally be wrapped around a pair of intercalender dryers, which can be used as cooling cylinders, in an S-shaped configuration. The intercalender dryers 20*a* and 20*b* are located between the first and second calender stacks 16 and 22, and can be used to cool the web 2 to enhance the temperature gradient in the web thickness direction by circulating cold water or other heat transfer fluid.

Each moisturizing shower 18 comprises a bank of independently controlled nozzles which are spaced at regular intervals in the cross direction (CD). The supply of fluid or steam to each nozzle is controlled by a computer (not shown), which receives moisture level feedback from moisture detectors (not shown), e.g., gamma gauges, situated downstream of the moisturizing showers, e.g., at the reel. The computer selectively applies moisture to the web to correct for nonuniformities in the CD moisture profile. The amount of moisture addition will range from 0.05–4% by weight per side. The moisture addition will be done in such a way that a uniform moisture level will be applied after the profiling is accomplished. The profiling and moisture addition can be done by a combination of one of more showers. If steam showers are used in conjunction with water showers, the preferred configuration would have the steam showers following the water showers. The location of the moisturizing showers will be such that the dwell time between moisturization and the heated nip location varies between 0.05 and 3 sec. Possible locations of the moisturizing showers 18 are shown in FIG. 2B, e.g., showers 18*a* and 18*b* located after the first multi-roll calender stack 16 and before the first intercalender dryer 20*a*; showers 18*c* and 18*d* located adjacent the first and second intercalender dryers 20*a* and 20*b*, respectively; and showers 18*e* and 18*f* located after the second intercalender dryer 20*b* and before the second multi-roll calender stack 22.

In accordance with one preferred embodiment of the invention, showers 18*c* and 18*d* are water showers, showers 18*e* and 18*f* are steam showers, and showers 18*a* and 18*b* are not included. In this configuration, the water showers (atomized) are designed to increase the moisture level, correct nonuniformity and cool the sheet to temperatures below 180° F. Cooling the web is intended to promote steam condensation and caliper preservation during calendering. The steam showers are located very close to the second calender stack so that the time between the steam application and the hot calendering is minimized. Minimizing this time will preserve a gradient in moisture across the thickness of the web. In accordance with this preferred embodiment, lubricant is added in the size press. Optionally, lubricant can be applied using the moisturizing showers.

In cases where more than one moisturizing shower is used to apply moisture to the same side, the second shower that applies moisture should be located as close to the heated nip 24 as possible. Preferably the dwell time between the moisturization using the first shower and calendering in the hot nip is 0.01 to 6 sec. In the case where both sides of the paper web need to be smoothened, the second calendering stack 22 will have two heated calender rolls and three heated pressure nips, as described hereinabove. However, if only one side of the paper web needs to be smoothened, then stack 22 can have only one heated calender roll and two heated pressure nips. In accordance with a further variation, the calender rolls above the single heated calender roll could be propped up to eliminate the first heated pressure nip, leaving only one heated pressure nip.

Figure 5:
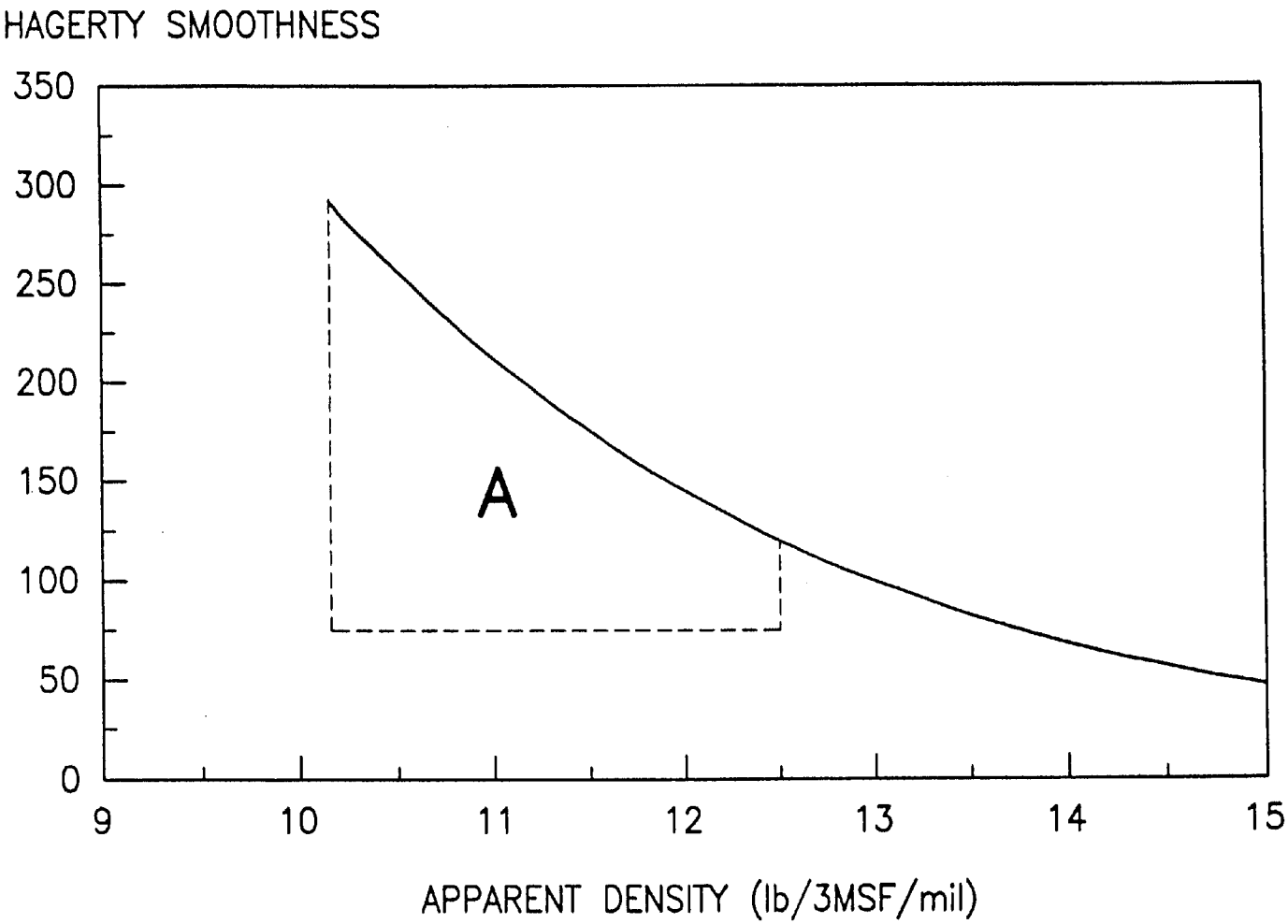
FIG. 5 is a graph showing the limit of the board products which can be produced using conventional machine calenders with or without waterboxes. The ordinate is the Hagerty smoothness and the abscissa is the apparent density (lb./3 MSF/mil) of the final product. The area A indicates the board products which can be produced using calender stacks which have been modified in accordance with the present invention.

In accordance with a further preferred embodiment of the invention, a pair of showers 26*a* and 26*b* are located on the side of the heated rolls 22*a* and 22*b* that are not wrapped by the paper web, to dispense lubricant that can prevent sticking. The lubricants sprayed can be commercially known dipersions/emulsions such as calcium stearate, polyethylene emulsion, polyglycerides and the like. The lubricant solution may be heated to prevent or reduce the cooling of the heated rolls during normal operation. The nipload applied in the heated nips can range from 100 to 1500 pli. The calendering process is designed to optimize the moisture addition and location in such a way that the finished smoothness of the calendered surface is in the range of 75–285 Hagerty/Sheffield units and the apparent density is in the range of 10.2–12.5 lb./3 MSF/mil. The area A in FIG. 5 indicates the board products (e.g., bleached board, file folder, bristol board which can be produced using calender stacks which have been modified in accordance with the present invention. The moisture addition will result in substantially permanent smoothness that cannot be reversed by subsequent aqueous treatment in a coating station, printing/tinting or other converting operations. The upper limit of area A in FIG. 5 is a curve which generally fits the following function:

$$\text{Hagerty Smoothness}=13429\ \exp(-0.37746\times\text{Apparent Density})$$

where apparent density is measured as basis weight/caliper or lb./3 MSF/mil.

In accordance with an alternative preferred embodiment of the invention, the lubricant may be incorporated into the moisturizing showers to eliminate the need for separate lubricant showers. Furthermore, the moisturizing showers may be used to add functional chemicals such as dyes and frictional additives.

Although the calendering line shown in FIG. 2B comprises two calender stacks separated by a pair of intercalender dryers, it should be appreciated that the present invention, at a minimum, requires only a single calender stack having a single hot nip. Thus, the wet stack 16 and the intercalender dryers 20*a* and 20*b* can be eliminated. Furthermore, the single calender stack could be a simple two-roll calender. When intercalender dryers are present, they are normally used to dry the sheet to lower the moisture that the web picks up in the wet stack. In the present invention, this drying is not needed because the waterboxes on the wet stack are not used. Therefore, the intercalender dryers can be used to cool the sheet by running cold water through them.

Thus, the present invention eliminates the need for waterboxes on calender stacks to achieve high levels of smoothness. This change results in better runnability because the waterboxes cause several types of breakdown that impede production. In addition, the elimination of the waterboxes makes it possible to improve the speed of the papermaking machine because the web need not be dried to the low levels (1–3%) that are typical in machines that use wet stacks. This invention is an improvement over the prior art in that moisturizing by means of showers is significantly lower in cost than moisturizing using a metering size press. Additionally, the moisturizing showers have a moisture level profiling capability that the metering size press lacks. This profiling capability is essential for correcting non-uniform moisture levels in the cross direction, which is characteristic of several papermaking machines. Finally, this invention incorporates lubricant solutions for preventing fiber sticking/picking in the heated nip, which is caused by starch and other additives previously added to the paper/paperboard in the size press.

Figure 3:
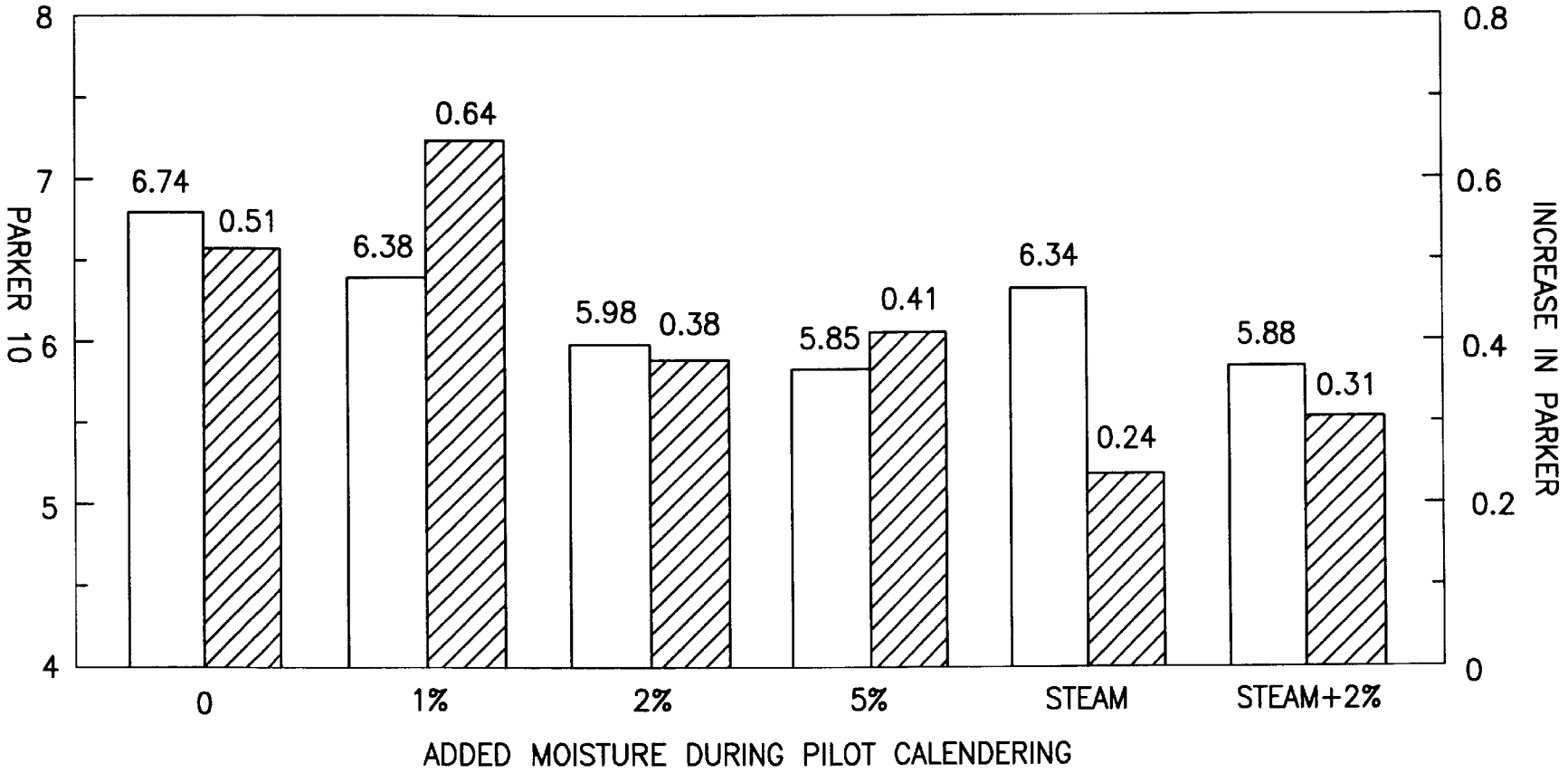
FIGS. 3 and 4 are graphs showing the smoothness (Parker at 10 kgf/cm$^2$) of rewetted file folders and the change in smoothness by rewetting as a function of the level of moisture added during temperature gradient calendering.
Figure 4:
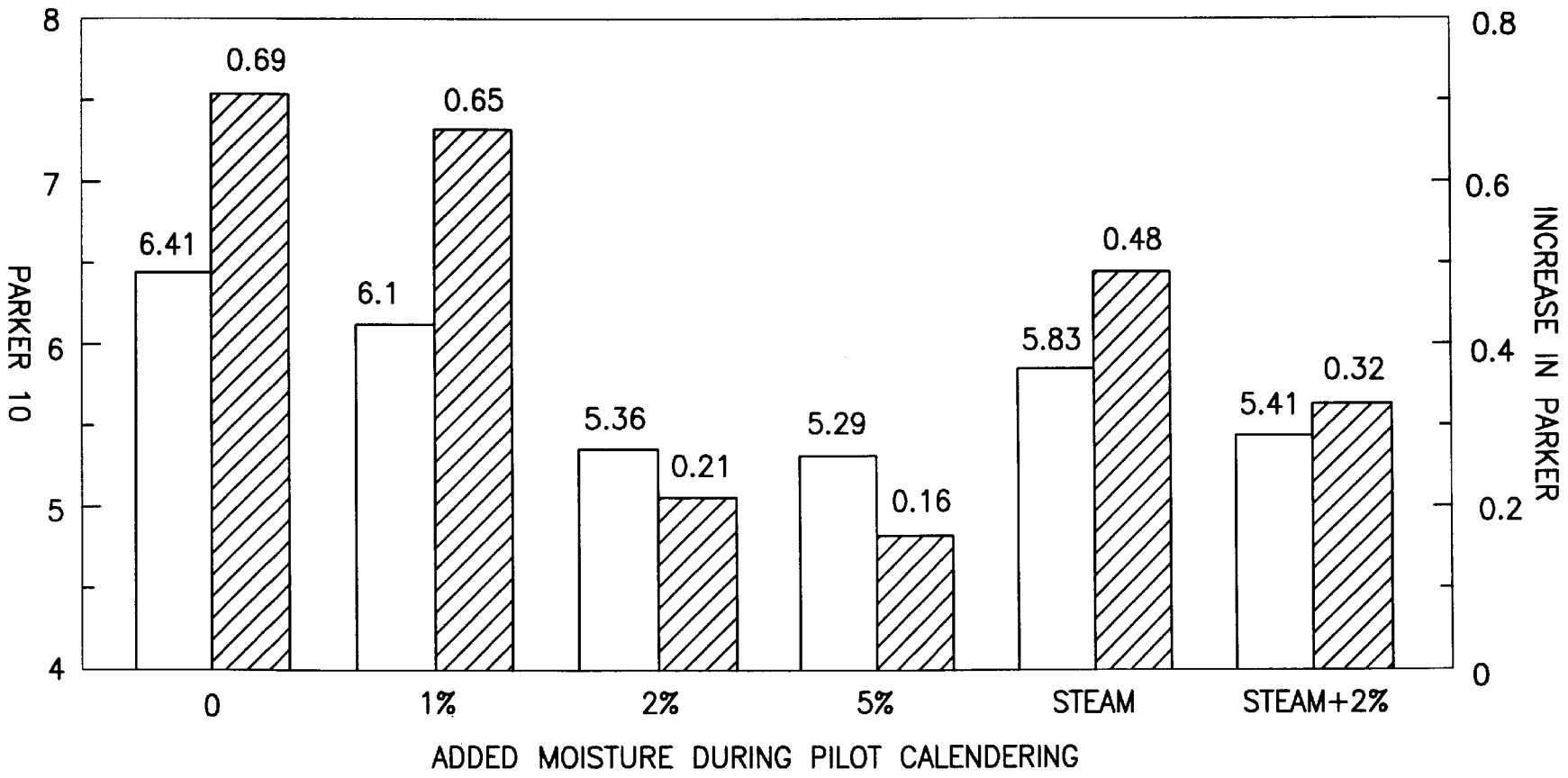

The moisture addition before hot nip calendering in accordance with the invention leads to substantially permanent smoothness. This is demonstrated by data derived from calendered and rewetted file folder samples. The file folder samples were calendered on a pilot calender using temperature and moisture gradient calendering at various levels of added moisture (0%, 1%, 2%, 5%, steam, and steam+2%) and at two different calender nip loads (200 and 600 pli). The calendered file folder samples were then rewetted in a lab size press. FIGS. 3 and 4 show the roughness of these calendered and rewetted file folders plotted as a function of the level of moisture added during calendaring with niploads of 200 pli (FIG. 3) and 600 pli (FIG. 4). The open bars represent the absolute Parker roughness after rewetting (relative to the left-hand scale), while the hatched bars represent the increase in Parker roughness by rewetting (relative to the right-hand scale). This data shows the marked increase in resistance to rewetting with increase in the level of added moisture, i.e., the increase in roughness due to rewetting was less for samples calendered with higher levels of added moisture.

The concept of spraying lubricants to eliminate sticking resulting from temperature gradient calendering of a moisturized board was tested on a laboratory scale. Uncalendered bleached board with surface sizing was moisturized and passed through a heated nip on a laboratory calender. Severe sticking/picking was observed. Spraying the roll with lubricant (a 0.5% calcium stearate dispersion or a 0.25% w/v polyethylene emulsion or 0.25% miscible polyglycerides) and repeating the calendering showed no sticking. Each of the lubricants was effective to a different degree.

A pilot scale evaluation was done by spraying calcium stearate (0.25%) or polyethylene emulsion (0.25%) on the heated calender roll while calendering a bleached board product with surface sizing after moisturizing to raise the moisture level by 2%. Both lubricants were effective in reducing sticking/picking and enhancing runnability.

This concept of spraying lubricant was further tested during temperature and moisture gradient calendaring of another grade of bleached board. The lubricant allowed hot calendering of moistened bleached board.

The concept of adding lubricants in the size press to eliminate sticking resulting from temperature gradient calendering of a moisturized board was also tested on a laboratory scale. Handsheets of bleached board were size press treated with preoxidized starch in a laboratory size press with varying levels (0.1–0.5%) of a polyglyceride-type lubricant in the formulation. These sheets were dried and calendered after moisturizing to increase the moisture content by 3%. The calendaring temperature was 280–290° F. The sheets treated with starch containing no lubricant exhibited significant sticking and picking to the heated roll, whereas the sheets treated with starch containing lubricant exhibited no sticking/picking.

The foregoing preferred embodiments of the invention have been disclosed for the purpose of illustration. Variations and modifications of the disclosed method of hot nip calendering will be readily apparent to practitioners skilled in the art. For example, a person skilled in the art of surface sizing will recognize that a vertical or horizontal size press configuration can be used in place of the inclined size press configuration disclosed hereinabove. Furthermore, the pressure nip formed by two heated calender rolls can be replaced by two pressure nips, each nip being formed by one heated and one unheated calender roll, the heated calender rolls being arranged to contact opposing sides of the web. All such variations and modifications which do not depart from the concept of the present invention are intended to be encompassed by the claims set forth hereinafter.

What is claimed is:

1. A method for temperature gradient calendering of a web of fibers, comprising the steps of:

continuously applying surface sizing to a first side of an advancing web;

continuously applying lubricant to said first side of the web;

drying the web after surface sizing;

applying moisture to said first side of the web after drying, the amount of moisture addition being in the range of 0.05–4% by weight;

smoothening said first side by calendering the moisturized and lubricated web in a pressure nip formed in part by a first heated calender roll having a surface temperature in the range of 250–400° F., said surface of said first heated calender roll contacting said first side of the web, and said pressure nip having a nipload in the range from 100 to 1,500 pli, wherein the dwell time for the web after moisturization and before said pressure nip is 0.01–6 sec, and said lubricant has the property of preventing sticking and picking of surface sizing and web fibers to said first heated calender roll.

2. The method as defined in claim 1, wherein said lubricant is applied to the web as a shower of liquid.

3. The method as defined in claim 1, wherein said step of applying moisture comprises the steps of applying water and then applying steam to said first side of the web.

4. The method as defined in claim 1 further comprising the steps of:

applying moisture to a second side of the web after drying such that nonuniformities in the moisture profile along the cross direction are corrected; and smoothening said second side by calendering the moisturized web in said pressure nip formed in part by a second heated calender roll having a surface temperature in the range of 250–400° F., said surface of said second heated calender roll contacting said second side of the web.

5. The method as defined in claim 4, wherein said steps of applying moisture comprise the steps of applying water and then applying steam to said first side of the web and applying water and then applying steam to said second side of the web.

6. The method as recited in claim 1, wherein said lubricant is a calcium stearate dispersion.

7. The method as recited in claim 1, wherein said lubricant is a polyethylene emulsion.

8. The method as recited in claim 1, wherein said lubricant is a miscible polyglyceride.

* * * * *